US007102612B2

(12) United States Patent
Sun

(10) Patent No.: US 7,102,612 B2
(45) Date of Patent: Sep. 5, 2006

(54) POWER-SAVING CIRCUITS AND METHODS FOR DRIVING ACTIVE MATRIX DISPLAY ELEMENTS

(75) Inventor: Wein-Town Sun, Kaohsiung (TW)

(73) Assignee: Au Optronics Corp., Hsinchu (TW)

( * ) Notice: Subject to any disclaimer, the term of this patent is extended or adjusted under 35 U.S.C. 154(b) by 473 days.

(21) Appl. No.: 10/606,860

(22) Filed: Jun. 27, 2003

(65) Prior Publication Data

US 2004/0263507 A1 Dec. 30, 2004

(51) Int. Cl.
*G09G 3/36* (2006.01)

(52) U.S. Cl. ..... 345/100; 345/98

(58) Field of Classification Search ..... 345/211–213, 345/87–100

See application file for complete search history.

(56) References Cited

U.S. PATENT DOCUMENTS 5,751,186 A * 5/1998 Nakao ..... 327/562
6,724,363 B1 * 4/2004 Satoh et al. ..... 345/100
2002/0154109 A1 * 10/2002 Ikeda ..... 345/211
2002/0186192 A1 * 12/2002 Maruoka et al. ..... 345/87

* cited by examiner

*Primary Examiner*—Ricardo Osorio
(74) *Attorney, Agent, or Firm*—Thomas, Kayden, Horstemeyer & Risley

(57) ABSTRACT

A power-saving circuit for an active matrix liquid crystal display ("LCD") panel that comprises a plurality of first capacitors, each first capacitor corresponding to a data line of the LCD panel for collecting electrical charge provided on an associated data line, at least one set of second capacitors, at least one set of transistors, each transistor of a set corresponding to one of the plurality of first capacitors, and at least two control signals, each control signal corresponding to a set of the at least one set of transistors and corresponding to a set of the at least one set of second capacitors, and each control signal functioning to switch between a first and a second state to control the operation state of an associated set of transistors, wherein the at least two control signals switch to a first state in a first sequence starting from a first control signal to a last control signal, and then in a second sequence starting from the last control signal to the first control signal, the first sequence alternating with the second sequence.

20 Claims, 7 Drawing Sheets

POWER-SAVING CIRCUITS AND METHODS FOR DRIVING ACTIVE MATRIX DISPLAY ELEMENTS

FIELD OF THE INVENTION

This invention relates in general to a circuit for driving liquid crystal display ("LCD") devices and, more particularly, to a circuit and method for reducing power required for driving LCD devices.

BACKGROUND OF THE INVENTION

LCD devices are widely used as a TV screen or a computer monitor for desktops and notebooks. In general, LCD devices are driven by using techniques that alternate the polarity of the voltages applied across a cell. These techniques may include inversion schemes such as frame inversion, row inversion, column inversion, and dot inversion. Typically, notwithstanding the inversion schemes, a higher image quality requires higher power consumption because of frequent polarity conversions. Such LCD devices, in particular thin film transistor ("TFT") LCD devices, may consume significant amounts of power, which may in turn generate excessive heat. The characteristics of the LCD devices will be significantly deteriorated due to the heat generated.

Charge sharing techniques have been developed in the art to reduce power consumption required by LCD devices. An exemplary column driver integrated circuit in the art uses multiplexers to selectively couple each of the columns to a common node during a portion of each row drive period. During the remaining portion of each row drive period, the multiplexers selectively couple voltage drivers to the columns of the LCD pixel array. In addition, the common node can be connected to an external storage capacitor.

Another power-saving circuit in the art uses switches and capacitors to passively change the voltage level on column electrodes without active driving by the column driver circuit. The power needed by the column driver circuit to drive voltages of alternating polarity onto the column electrodes is significantly reduced, particularly for the pixel inversion and the row inversion schemes.

The prior art techniques may save a significant amount of power in the column inversion and the dot inversion and row inversion schemes, respectively. However, these techniques in the art are not particularly effective in other schemes. It is desirable that a circuit is designed to achieve significant power saving in all the inversion schemes.

SUMMARY OF THE INVENTION

Accordingly, the present invention is directed to a circuit and method that obviate one or more of the problems due to limitations and disadvantages of the related art.

To achieve these and other advantages, and in accordance with the purpose of the invention as embodied and broadly described, there is provided a power-saving circuit for an active matrix liquid crystal display ("LCD") panel that comprises a plurality of first capacitors, each first capacitor corresponding to a data line of the LCD panel for collecting electrical charge provided on an associated data line, at least one set of second capacitors, at least one set of transistors, each transistor of a set corresponding to one of the plurality of first capacitors, and at least two control signals, each control signal corresponding to a set of the at least one set of transistors and corresponding to a set of the at least one set of second capacitors, and each control signal functioning to switch between a first and a second state to control the operation state of an associated set of transistors, wherein the at least two control signals switch to a first state in a first sequence starting from a first control signal to a last control signal, and then in a second sequence starting from the last control signal to the first control signal, the first sequence alternating with the second sequence.

In one aspect, each second capacitor of a set in response to a first state of an associated control signal reaches a voltage level that is an average of a voltage level of the each second capacitor held at a previous first state of the associated control signal and a voltage level of an associated first capacitor in proportion to the capacitance values of the each second capacitor and the associated first capacitor.

In another aspect, each transistor includes a gate coupled to an associated control signal, a first terminal coupled to an associated first capacitor, and a second terminal coupled to an associated second capacitor.

Also in accordance with the present invention, there is provided a power-saving circuit for an active matrix liquid crystal display ("LCD") panel that comprises a plurality of first capacitors, each first capacitor corresponding to a data line of the LCD panel for collecting electrical charge provided on an associated data line, a plurality of second capacitors, a plurality of transistors, each transistor including a gate, a first terminal coupled to one of the plurality of first capacitors, and a second terminal coupled to one of the plurality of second capacitors, and a control signal coupled to the gates of the plurality of transistors, and functioning to switch between a first and a second state to control the operation state of the plurality of transistors, wherein each second capacitor in response to a first state of the control signal reaches a voltage level that is an average of a voltage level of the each second capacitor held at a previous first state of the control signal and a voltage level of an associated first capacitor in proportion to the capacitance values of the each second capacitor and the associated first capacitor.

In one aspect, each first capacitor includes a first capacitance value, and each second capacitor includes a second capacitance value substantially the same as the first capacitance value.

Still in accordance with the present invention, there is provided a method of power saving for an active matrix liquid crystal display ("LCD") panel that comprises providing a plurality of first capacitors, electrically coupling each first capacitor to a data line of the LCD panel, providing at least one set of transistors, electrically coupling each transistor of a set to one of the plurality of first capacitors, providing at least one set of second capacitors, electrically coupling each set of second capacitors to a set of transistors, providing at least one control signal, electrically coupling each control signal to a set of transistors, each control signal functioning to switch between a first and a second state to control the operation state of an associated set of transistors, switching the at least one control signal to a first state in a first sequence starting from a first control signal to a last control signal such that voltage levels of a second capacitor and an associated first capacitor are averaged in proportion to their respective capacitance values, and switching the at least one control signal in a second sequence starting from the last control signal to the first control signal such that voltage levels of a second capacitor and an associated first capacitor are averaged in proportion to their respective capacitance values.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawing, which is incorporated in and constitutes a part of this specification, illustrates several embodiments of the invention and together with the description, serves to explain the principles of the invention.

DESCRIPTION OF THE EMBODIMENTS

Reference will now be made in detail to the present embodiment of the invention, an example of which is illustrated in the accompanying drawings. Wherever possible, the same reference numbers will be used throughout the drawings to refer to the same or like parts.

Figure 1:
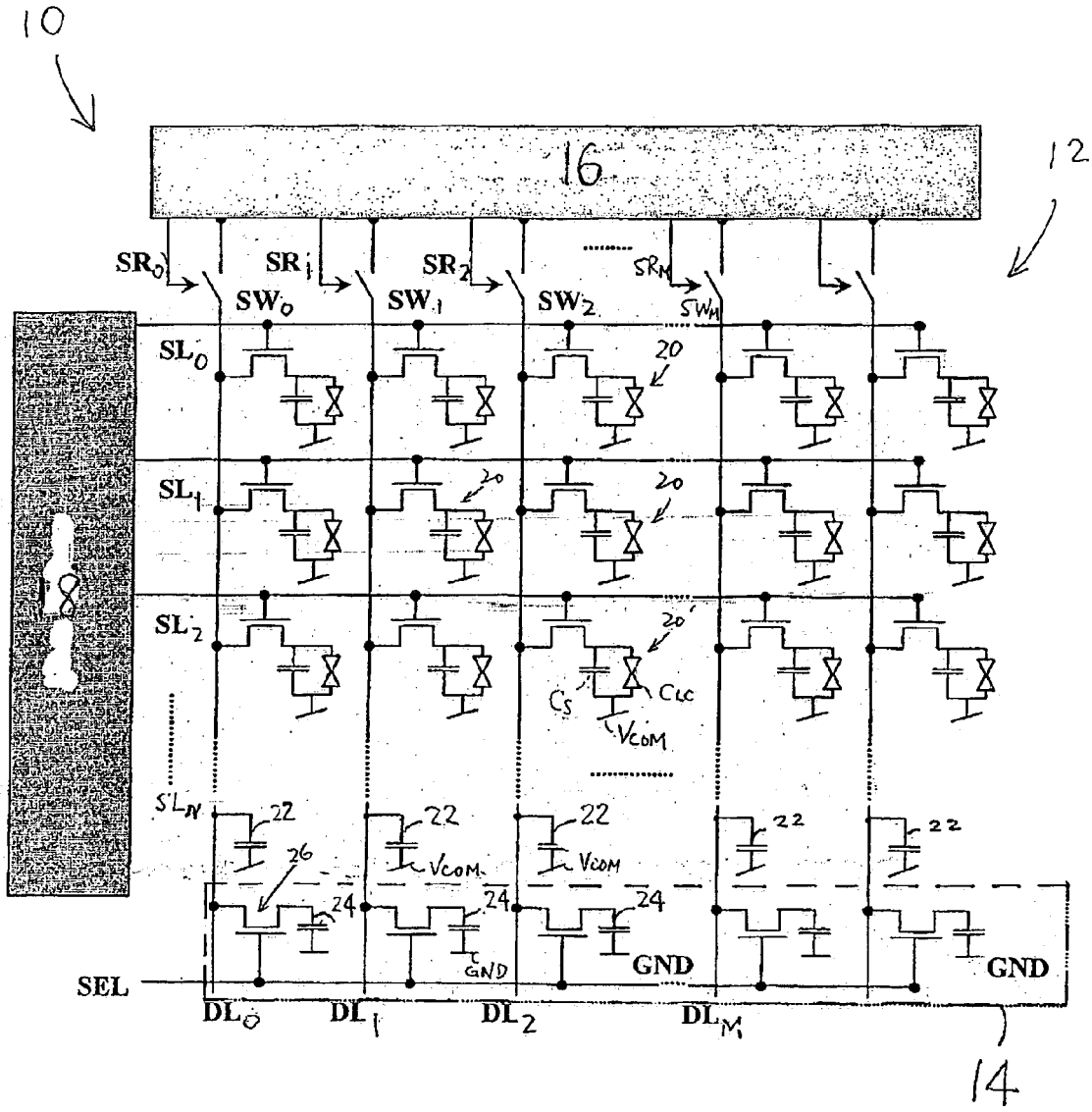
FIG. 1 is a circuit diagram of a liquid crystal display ("LCD") panel in accordance with one embodiment of the present invention.

FIG. 1 shows a circuit diagram of a liquid crystal display ("LCD") panel 10 in accordance with one embodiment of the present invention. Referring to FIG. 1, LCD panel 10 includes a LCD 12, a plurality of first capacitors 22 and a charge-sharing circuit 14. LCD 12 includes a data driver 16, a scan driver 18, and a matrix of cells 20. A representative cell 20' is located near an intersection of a scan line $SL_2$ and a data line $DL_2$. Data driver 16 functions to supply a video signal to each of the cells 20 through a corresponding data line $DL_0$, $DL_1$, . . . or $DL_M$. A plurality of control signals $SR_0$, $SR_1$ . . . $SR_M$ generated from data driver 16 are provided to control video signals for output to cells 20 through corresponding switches $SW_0$, $SW_1$ . . . $SW_M$. Scan driver 18 functions to select a scan line $SL_0$, $SL_1$ . . . or $SL_N$ to turn on cells 20 associated with the scan line. Representative cell 20' includes an active matrix thin film transistor (not numbered) including a gate (not numbered) coupled to a corresponding scan line $SL_2$, a drain (not numbered) coupled to a corresponding data line $DL_2$, and a source (not numbered) coupled to one ends of a storage capacitor $C_S$ and a liquid crystal capacitor $C_{LC}$ connected in parallel. The other ends of storage capacitor $C_S$ and liquid crystal capacitor $C_{LC}$ are coupled to an electrode (not shown) to which a common voltage $V_{COM}$ is applied.

Charge-sharing circuit 14 includes a plurality of second capacitors 24, a plurality of transistors 26, and a control signal SEL. Each transistor 26 includes a gate (not numbered) coupled to control signal SEL, a first terminal (not numbered) coupled to one end of a corresponding first capacitor 22, and a second terminal (not numbered) coupled to one end of a corresponding second capacitor 24. The other end of each first capacitor 22 is coupled to a common electrode (not shown) of LCD 12 to which common voltage $V_{COM}$ is applied. The other end of each second capacitor 24 is coupled to a reference level or ground GND. Control signal SEL functions to switch between a first state and a second state. In one embodiment according to the invention, the first state represents a high level voltage signal to turn on transistors 26, and the second state represents a low level voltage signal to turn off transistors 26.

Transistors 26 may include amorphous thin film transistors ("TFT") or poly-crystalline thin film transistors. In one embodiment according to the invention, amorphous thin film transistors are used to simplify the fabrication process as the transistors of cells 20 are also amorphous TFTs. First capacitors 22 may include parasitic capacitances formed associated with data lines $DL_1$ to $DL_M$. In one embodiment, first capacitors 22 and second capacitors 24 have substantially the same capacitance values, for example, approximately 5 pico farads (pF). Operation of power-saving circuit 14 is described in further detail by reference to FIG. 2 where first capacitors 22 and second capacitors 24 have substantially the same capacitance values.

Figure 2:
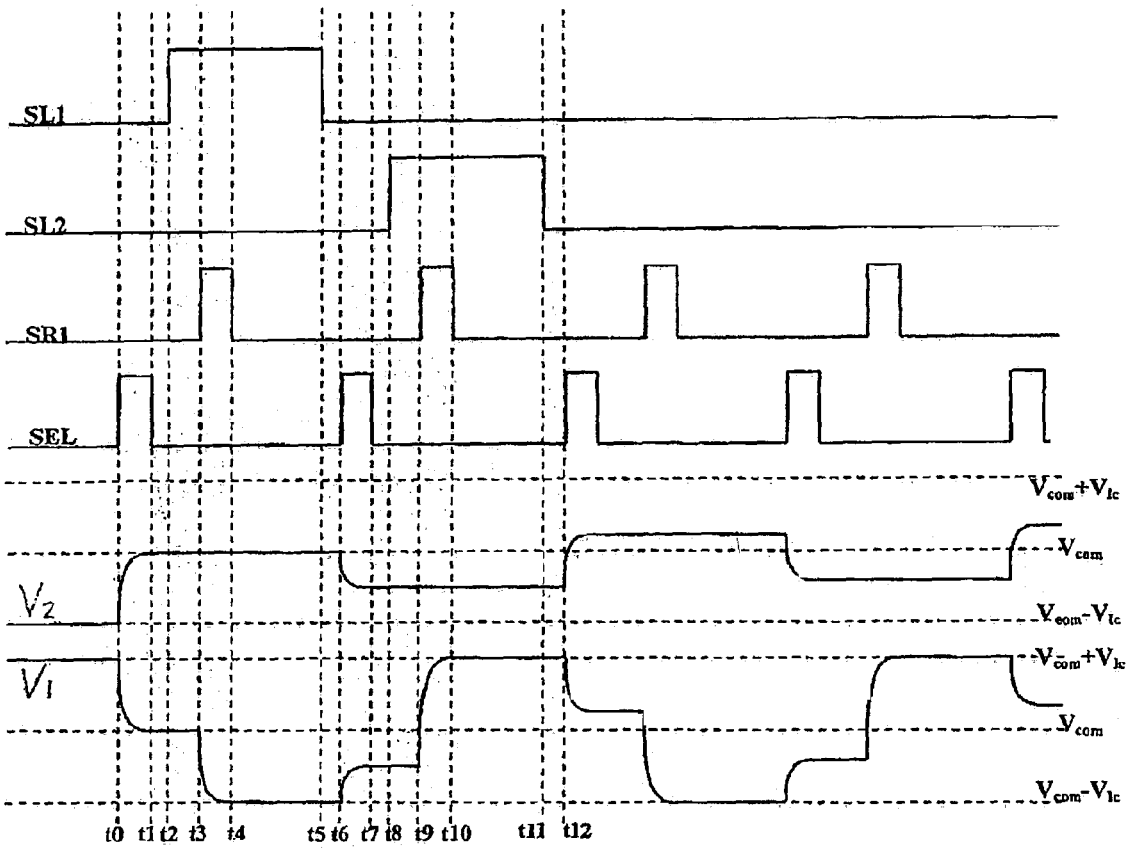
FIG. 2 is a timing diagram for the LCD panel shown in FIG. 1.

FIG. 2 is a timing diagram for LCD panel 10 shown in FIG. 1. Referring to FIG. 2, prior to time $t_0$, the voltage level $V_1$ of first capacitor 22 and the voltage level $V_2$ of second capacitor 24 have an initial value of $V_{COM}+V_{CL}$ and $V_{COM}-V_{CL}$, respectively, where $V_{COM}$ is a voltage applied to a common electrode of LCD 12, and $V_{LC}$ is a voltage difference between a pixel electrode and a common electrode formed on opposite sides of a liquid crystal layer of LCD 12 having a black-scale image. At time $t_0$, control signal SEL switches to a first state and does not switch to a second state to turn off transistors 26 until $t_1$. The high voltage-level control signal SEL turns on transistors 26 such that electrical charge collected in first capacitors 22 and second capacitors 24 are averaged in proportion to, or precisely, in a reverse proportion to their respective capacitance values. Since it is assumed that each first capacitor 22 and second capacitor 24 have substantially the same capacitance value, voltage levels $V_1(=V_{COM}+V_{CL})$ and $V_2(=V_{COM}-V_{CL})$ become $V_{COM}$ and $V_{COM}$, respectively.

At time $t_2$, scan driver 18 selects a scan line, for example $SL_1$, to start a row drive period. During the row drive period from $t_2$ to $t_5$, at time $t_3$, data driver 16 outputs a high level control signal $SR_1$ to turn on switch $SW_1$ to allow a new video image signal to refresh the voltage level on data line $DL_1$, and in turn the voltage level $V_1$ of first capacitor 22 associated with data line $DL_1$ to $V_{COM}-V_{CL}$. With second capacitors 24, data driver 16 charges data lines $DL_0$ to $DL_M$ from $V_{COM}$ to $V_{COM}-V_{CL}$, instead of from $V_{COM}+V_{CL}$ to $V_{COM}-V_{CL}$. At time $t_6$, control signal SEL switches to a first state again. Voltage levels $V_1(=V_{COM}-V_{CL})$ and $V_2(=V_{COM})$ are averaged and become $V_{COM}-\frac{1}{2}V_{CL}$ and $V_{COM}-\frac{1}{2}V_{CL}$, respectively.

At time $t_9$, first capacitors 22 are charged with a voltage level $V_{COM}+V_{CL}$ from $V_{COM}-\frac{1}{2}V_{CL}$, instead of from $V_{COM}-V_{CL}$ to $V_{COM}+V_{CL}$. At time $t_{12}$, control signal SEL switches to a first state, and voltage levels $V_1(=V_{COM}+V_{CL})$ and $V_2(=V_{COM}-\frac{1}{2}V_{CL})$ are averaged to become $V_{COM}+\frac{1}{4}V_{CL}$ and $V_{COM}+\frac{1}{4}V_{CL}$, respectively. The charge sharing procedure between each first capacitor 22 and its associated second capacitor 24 continues in response to a first state of control signal SEL.

Figure 3:
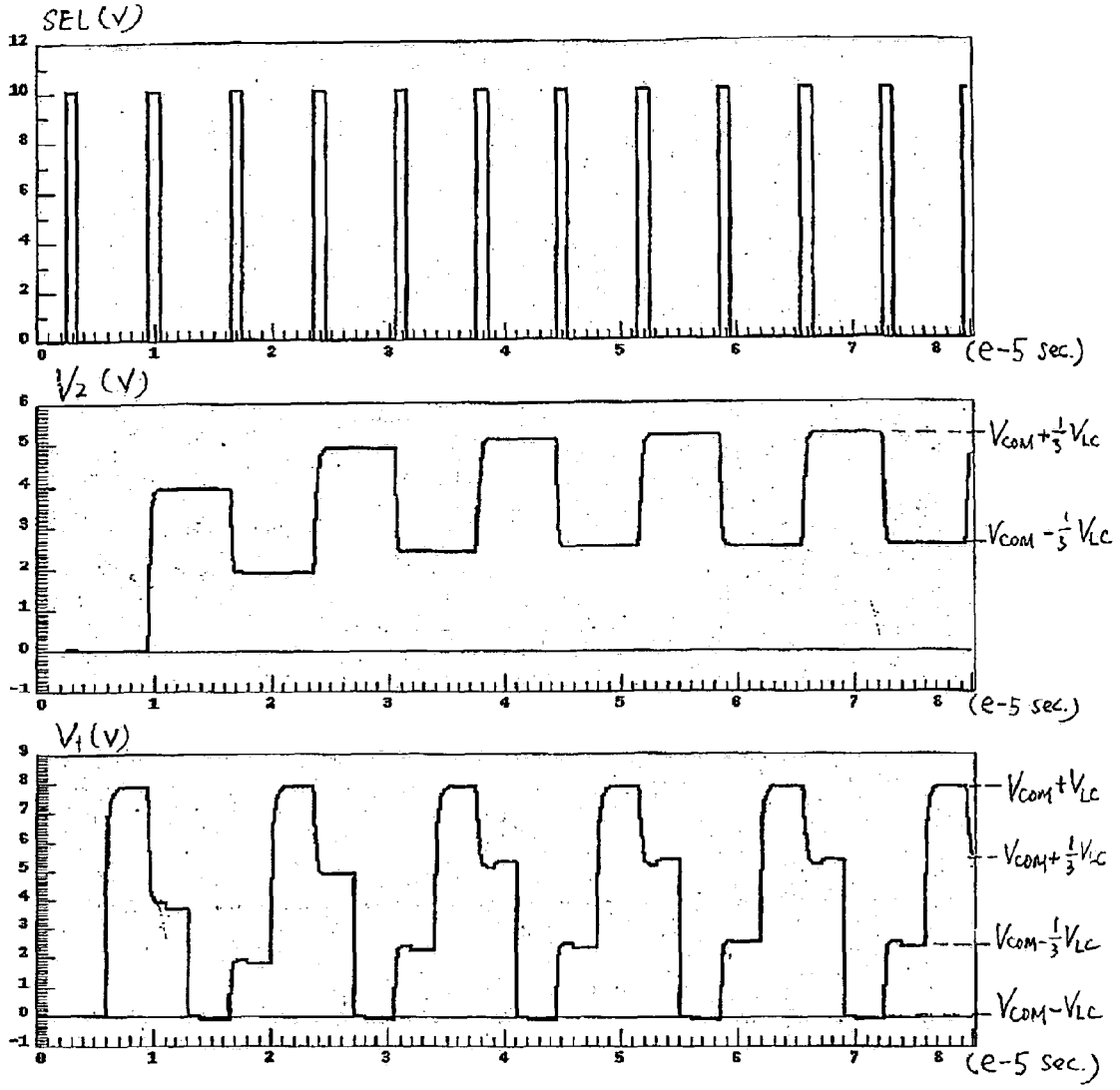
FIG. 3 is another timing diagram for the LCD panel shown in FIG. 1.

FIG. 3 shows a result of computer simulation for the charge sharing procedure shown in FIG. 2. Referring to FIG. 3, after a sufficiently long time, voltage level $V_2$ of second capacitors 24 swings between a stable region $V_{COM}+\frac{1}{3}V_{LC}$ and $V_{COM}-\frac{1}{3}V_{LC}$. Besides, after a sufficiently long time, during a row drive period, first capacitors 22 discharges from $V_{COM}+\frac{1}{3}V_{LC}$ to $V_{COM}-V_{LC}$, instead of from $V_{COM}+V_{LC}$ to $V_{COM}-V_{LC}$, or charges from $V_{COM}-\frac{1}{3}V_{LC}$ to $V_{COM}+V_{LC}$, instead of from $V_{COM}-V_{LC}$ to $V_{COM}+V_{LC}$, resulting in a reduction of power consumption. Skilled persons would understand that a same result of the above-mentioned stable regions of $V_1$ and $V_2$ is able to be achieved despite the initial values of $V_1$ and $V_2$.

Figure 4:
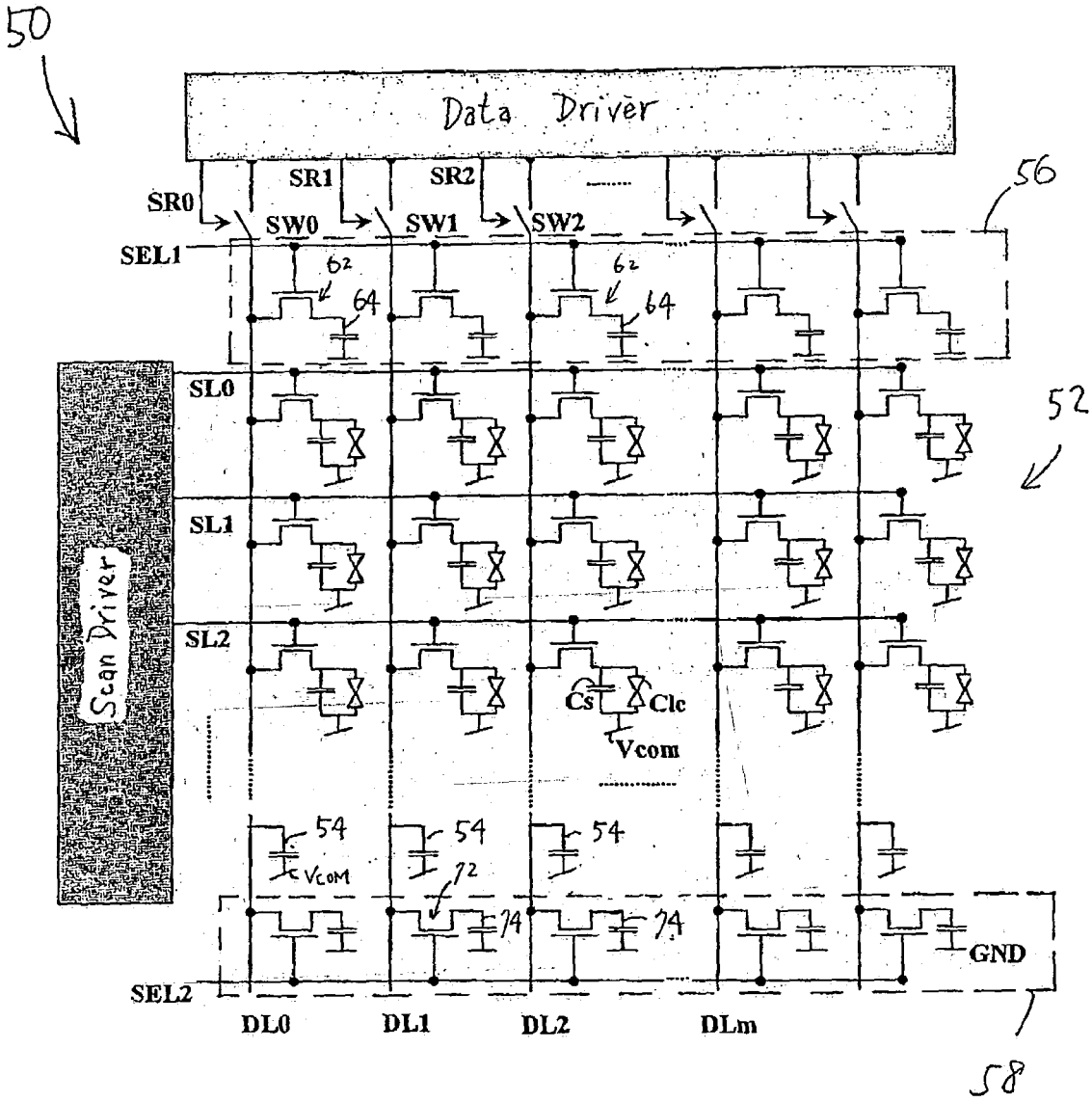
FIG. 4 is a circuit diagram of a LCD panel in accordance with another embodiment of the present invention.

FIG. 4 is a circuit diagram of a LCD panel 50 in accordance with another embodiment of the present invention. Referring to FIG. 4, LCD panel 50 includes a LCD 52 and a power-saving circuit (not numbered). The power-saving circuit includes a plurality of first capacitors 54, a first charge-sharing circuit 56, a second charge-sharing circuit 58, and control signals $SEL_1$ and $SEL_2$. First charge-sharing circuit 56 includes a first set of transistors 62 and first set of second capacitors 64. Similarly, second charge-sharing circuit 58 includes a second set of transistors 72 and second set of second capacitors 74. First charge-sharing circuit 56 is formed between a data driver (not numbered) and a cell matrix (not numbered) of LCD 12. Control signals $SEL_1$ and $SEL_2$ function to switch between a first state and a second state to respectively turn on and turn off associated transistors 62 and 72.

In one embodiment according to the invention, first and second sets of transistors 62 and 72 include amorphous or poly-crystalline TFTs. First capacitors 54 and second capacitors 64 and 72 include substantially the same capacitance values. In one embodiment according to the invention, the capacitance value of each first capacitor 54 and second capacitors 64 and 74 is approximately 5 pico farads (pF). Operation of the power-saving circuit is explained below by reference to FIG. 5 under the case that first capacitors 54 and second capacitors 64 and 74 have substantially the same capacitance values.

Figure 5:
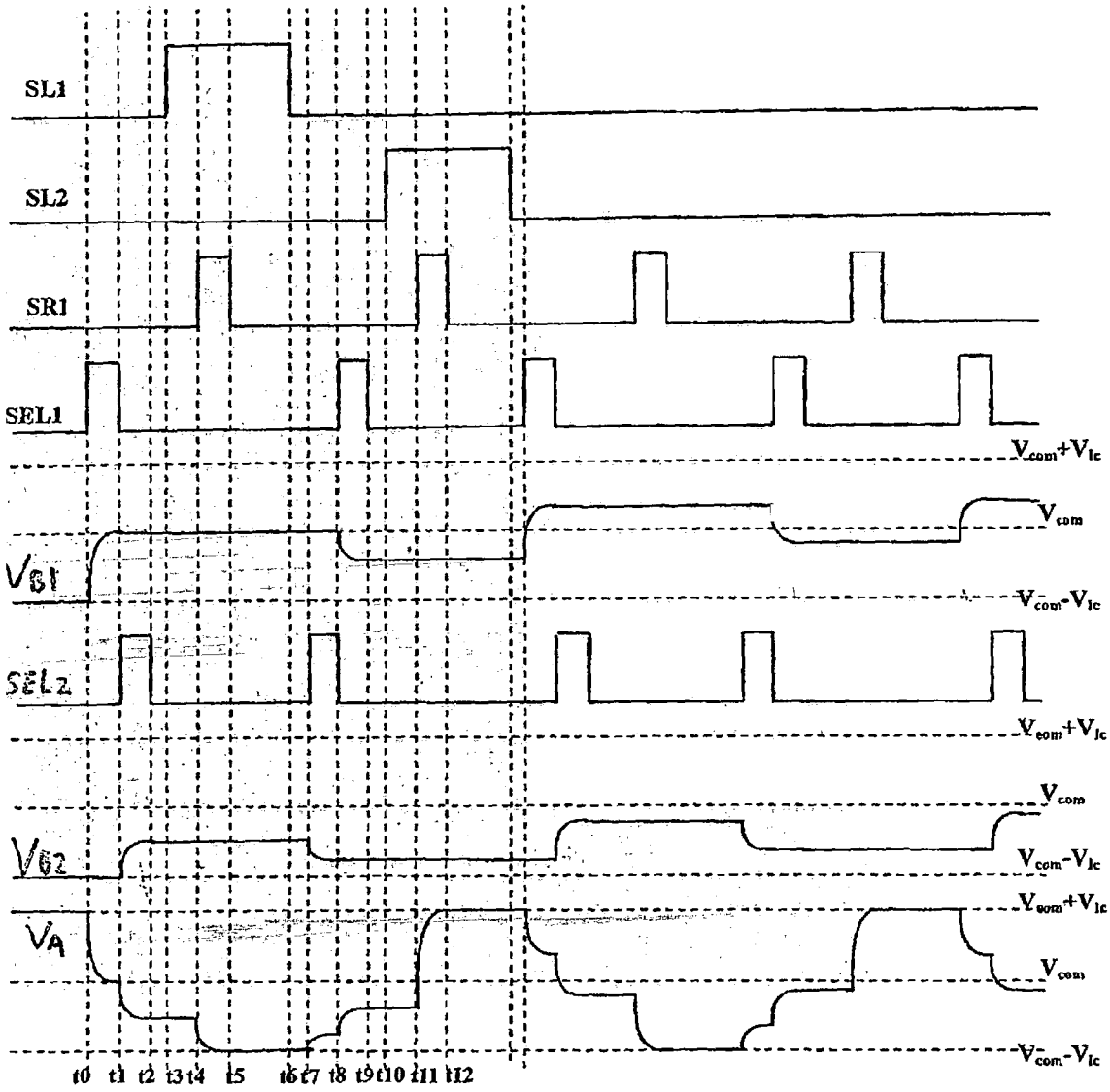
FIG. 5 is a timing diagram for the LCD panel shown in FIG. 4.

FIG. 5 is a timing diagram for LCD panel 50 shown in FIG. 4. Referring to FIG. 5, prior to time $t_0$, it is assumed that the voltage levels $V_A$ of first capacitors 54, $V_{B1}$ of first set of second capacitors 64, and $V_{B2}$ of second set of second capacitors 74 have an initial value of $V_{COM}+V_{CL}$, $V_{COM}-V_{CL}$, and $V_{COM}-V_{CL}$, respectively. At time $t_0$, control signal $SEL_1$ switches to a first state and does not switch to a second state to turn off first set of transistors 62 until $t_1$. The high voltage-level control signal $SEL_1$ turns on first set of transistors 62 such that electrical charge collected in first capacitors 54 and first set of second capacitors 64 are averaged. Voltage levels $V_A(=V_{COM}+V_{CL})$ and $V_{B1}(=V_{COM}-V_{CL})$ become $V_{COM}$ and $V_{COM}$, respectively.

At time $t_1$, control signal $SEL_2$ switches to a first state and does not switch to a second state to turn off second set of transistors 72 until $t_2$. The high voltage-level control signal $SEL_2$ turns on second set of transistors 72 such that electrical charge collected in first capacitors 54 and second set of second capacitors 74 are averaged. Voltage levels $V_A(=V_{COM})$ and $V_{B2}(=V_{COM}-V_{CL})$ become $V_{COM}-\frac{1}{2}V_{CL}$ and $V_{COM}-\frac{1}{2}V_{CL}$, respectively. In one embodiment according to the invention, control signals come from a same clock source (not shown) that applies control signals to first and second charge-sharing circuits 56 and 58 at different time periods.

At time $t_3$, a row drive period occurs. During the row drive period from $t_3$ to $t_6$, at time $t_4$, a video image signal is sent to refresh the voltage level $V_A$ of first capacitors 54 to $V_{COM}-V_{CL}$. With second capacitors 64 and 74, data lines $DL_0$ to $DL_M$ are charged from $V_{COM}-\frac{1}{2}V_{CL}$ to $V_{COM}-V_{CL}$, instead of from $V_{COM}+V_{CL}$ to $V_{COM}-V_{CL}$. At time $t_7$, control signal $SEL_2$ switches to a first state again. Voltage levels $V_A(=V_{COM}-V_{CL})$ and $V_{B2}(=V_{COM}-\frac{1}{2}V_{CL})$ are averaged and become $V_{COM}-\frac{3}{4}V_{CL}$ and $V_{COM}-\frac{3}{4}V_{CL}$, respectively. At time $t_8$, control signal $SEL_1$ switches to a first state. Voltage levels $V_A(=V_{COM}-\frac{3}{4}V_{CL})$ and $V_{B1}(=V_{COM})$ are averaged and become $V_{COM}-\frac{3}{8}V_{CL}$ and $V_{COM}-\frac{3}{8}V_{CL}$, respectively.

Next, at time $t_{10}$, another row drive period occurs. During the row drive period starting from $t_{10}$, at time $t_{11}$, a video image signal is sent to refresh the voltage level $V_A$ of first capacitors 54 to $V_{COM}+V_{CL}$. With second capacitors 64 and 74, data lines $DL_0$ to $DL_M$ are charged from $V_{COM}-\frac{3}{8}V_{CL}$ to $V_{COM}+V_{CL}$, instead of from $V_{COM}-V_{CL}$ to $V_{COM}+V_{CL}$. The charge sharing procedure between each first capacitor 54 and second capacitor 64 or 74 continues in response a first state of control signal $SEL_1$ and $SEL_2$, respectively.

Figure 6:
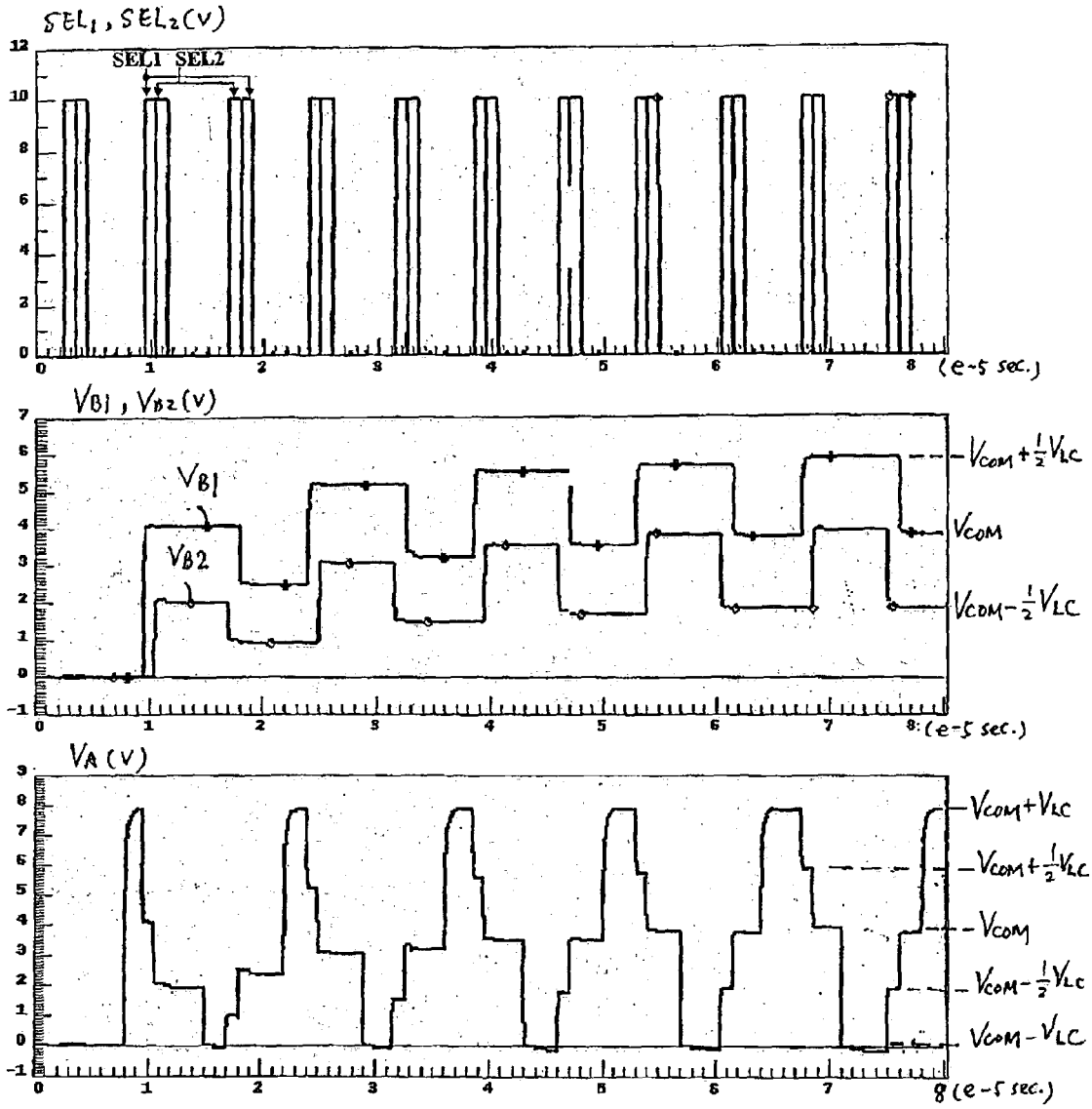
FIG. 6 is another timing diagram for the LCD panel shown in FIG. 4.

FIG. 6 shows a result of computer simulation for the charge sharing procedure shown in FIG. 5. Referring to FIG. 6, after a sufficiently long time, voltage level $V_{B1}$ of first set of second capacitors 64 swings between a stable region $V_{COM}+\frac{1}{2}V_{LC}$ and $V_{COM}$, and voltage level $V_{B2}$ of second set of second capacitors 74 swings between a stable region $V_{COM}$ and $V_{COM}-\frac{1}{2}V_{LC}$. Besides, after a sufficiently long time, during a row drive period, first capacitors 54 discharges from $V_{COM}+\frac{1}{2}V_{LC}$, $V_{COM}$ to $V_{COM}-V_{LC}$, instead of from $V_{COM}+V_{LC}$ to $V_{COM}-V_{LC}$, or charges from $V_{COM}-\frac{1}{2}V_{LC}$, $V_{COM}$ to $V_{COM}+V_{LC}$, instead of from $V_{COM}-V_{LC}$ to $V_{COM}+V_{LC}$, resulting in a reduction of power consumption. Skilled persons would understand that a same result of the above-mentioned stable regions of $V_A$, $V_{B1}$ and $V_{B2}$ is able to be achieved despite the initial values of $V_A$, $V_{B1}$ and $V_{B2}$.

Although only LCD panel 10 including one charge-sharing circuit 14 and LCD panel 50 including two charge-sharing circuits 56 and 58 are described in the above-mentioned embodiments, skilled persons in the art would understand that the embodiments support more than two charge-sharing circuits. As an example of a LCD panel (not shown) including three charge-sharing circuits (not shown), three control signals (not shown) are respectively used to control the transistors (not shown) of the three charge-sharing circuits. The three control signals switch to a first state in a first sequence starting from a first control signal to a third control signal such that the voltage levels of a first, second, and third sets of second capacitors (not shown) of a first, second, and third charge-sharing circuits are averaged with the voltage level of first capacitors (not shown), respectively. Then the three control signals switch to another first state in a second sequence starting from the third control signal to the first control signal such that the voltage levels of the first, second, and third sets of second capacitors held at the previous first state are averaged with the voltage level of the first capacitors, respectively. The first sequence alternates with the second sequence.

Figure 7:
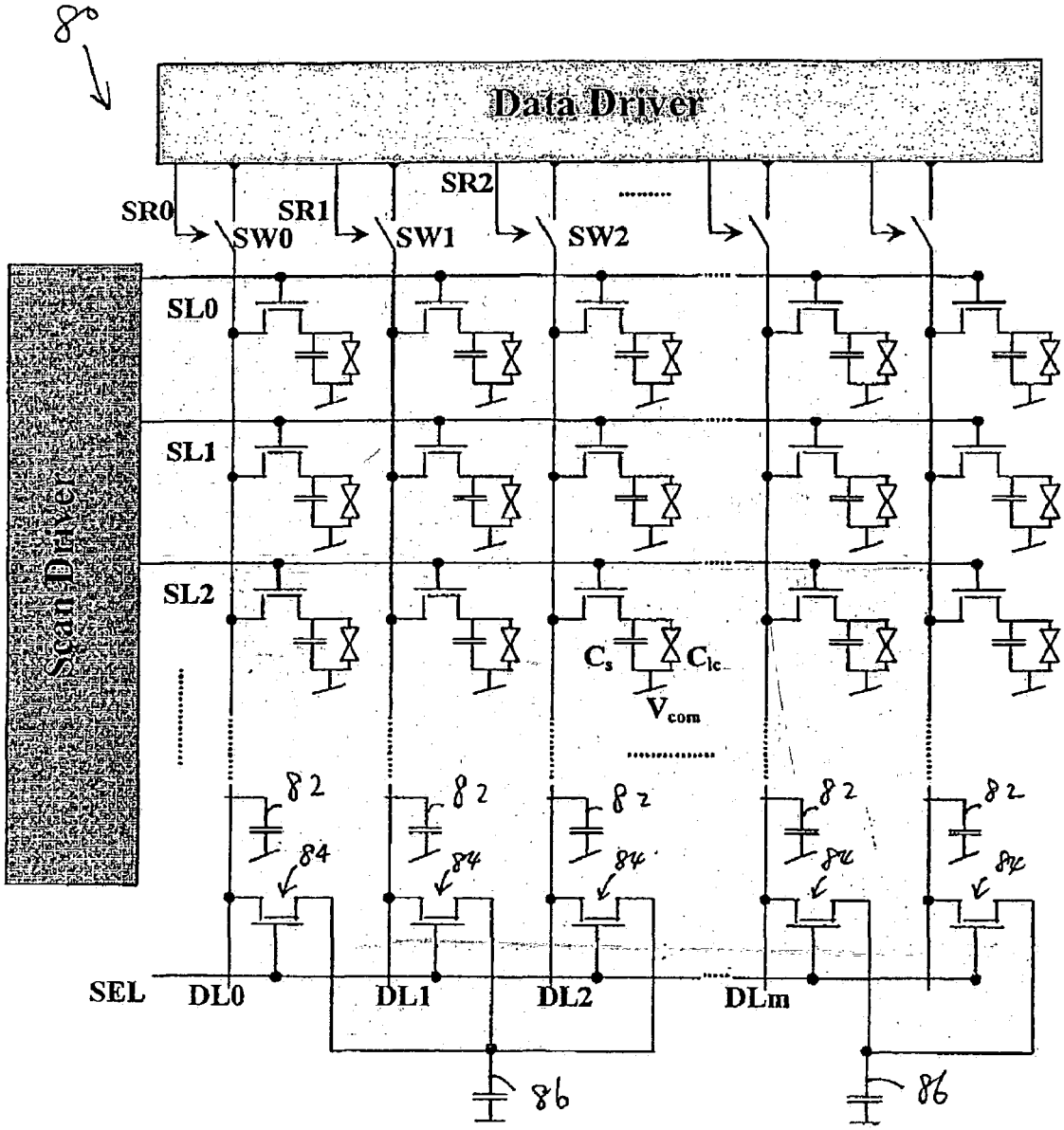
FIG. 7 is a circuit diagram of a LCD panel in accordance with one embodiment of the present invention.

Skilled persons in the art would also understand that a subset of transistors of a charge-sharing circuit may be coupled to a same second capacitor, as shown in FIG. 7. Referring to FIG. 7, a LCD panel 80 in accordance with one embodiment of the present invention includes a plurality of first capacitors 82, and a charge-sharing circuit (not numbered) including a plurality of transistors 84 and a plurality of second capacitors 86. In this example, every three transistors 84 are coupled to a second capacitor 86.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A power-saving circuit for an active matrix liquid crystal display ("LCD") panel having a cell matrix, comprising:

a plurality of first capacitors, each first capacitor corresponding to a data line of the LCD panel for collecting electrical charge provided on an associated data line;

at least one set of second capacitors disposed outside the cell matrix;

at least one set of transistors disposed outside the cell matrix, each transistor of a set corresponding to one of the plurality of first capacirors; and at least two control signals, each control signal corresponding to a set of the at least one set of transistors and corresponding to a set of the at least one set of second capacitors, and each control signal functioning to switch between a first and a second state to control the operation state of an associated set bf transistors, wherein the at least two control signals switch to a first state in a first sequence starting from a first control signal to a last control signal, and then in a second sequence starting from the last control signal to the first control signal, the first sequence alternating with the second sequence.

2. The circuit of claim 1, wherein each second capacitor of a set in response to a first state of an associated control signal reaches a voltage level that is an average of a voltage level of the each second capacitor held at a previous first state of the associated control signal and a voltage level of an associated first capacitor in proportion to the capacitance values of the each second capacitor and the associated first capacitor.

3. The circuit of claim 1, wherein each transistor includes a gate coupled to an associated control signal, a first terminal coupled to an associated first capacitor, and a second terminal coupled to an associated second capacitor.

4. The circuit of claim 3, wherein the second terminals of a subset of transistors of a set are coupled to a same second capacitor.

5. The circuit of claim 1, wherein each first capacitor includes a first capacitance value, and each second capacitor includes a second capacitance value substantially the same as the first capacitance value.

6. The circuit of claim 5, wherein the first and second capacitance values are predetermined.

7. The circuit of claim 1, wherein the at least two control signals include a first control signal and a second control signal, and a voltage level of one set of second capacitors associated with the first control signal swings between $V_{COM}+\frac{1}{2}V_{LC}$ and $V_{COM}$, and a voltage level of the other set of second capacitors associated with the second control swings between $V_{COM}$ and $V_{COM}-\frac{1}{2}V_{LC}$, where $V_{COM}$ is a voltage applied to a common electrode of the LCD panel, and $V_{LC}$ is a voltage difference between a pixel electrode and a common electrode of the LCD panel during a black-scale image.

8. The circuit of claim 1, wherein a set of second capacitors is formed between a data driver and a cell matrix driven by the data driver of the LCD panel.

9. A power-saving circuit for an active matrix liquid crystal display ("LCD") panel, comprising:

a plurality of first capacitors, each first capacitor corresponding to a data line of the LCD panel for collecting electrical charge provided on an associated data line;

a plurality of second capacitors;

a plurality of transistors, each transistor including a gate, a first terminal coupled to one of the plurality of first capacitors, and a second terminal coupled to one of the plurality of second capacitors; and a control signal coupled to the gates of the plurality of transistors, and functioning to switch between a first and a second state to control the operation state of the plurality of transistors, wherein each second capacitor in response to a first state of the control signal reaches a voltage level that is an average of a voltage level of the each second capacitor held at a previous first state of the control signal and a voltage level of an associated first capacitor in proportion to the capacitance values of the each second capacitor and the associated first capacitor.

10. The circuit of claim 9, wherein each first capacitor includes a first capacitance value, and each second capacitor includes a second capacitance value substantially the same as the first capacitance value.

11. The circuit of claim 10, wherein the first and second capacitance values are predetermined.

12. The circuit of claim 9, wherein the second terminals of a subset of the plurality of transistors are coupled to a same second capacitor.

13. The circuit of claim 9, wherein the number of the plurality of transistors is same as that of the plurality of second capacitors.

14. The circuit of claim 9, wherein the a voltage level of one of the second capacitors swings between $V_{COM}+\frac{1}{3}V_{LC}$ and $V_{COM}-\frac{1}{3}V_{LC}$, where $V_{COM}$ is a voltage applied to a common electrode of the LCD panel, and $V_{LC}$ is a voltage difference between a pixel electrode and a common electrode of the LCD panel during a black-scale image.

15. A method of power saving for an active matrix liquid crystal display ("LCD") panel having a cell matrix, comprising:

providing a plurality of first capacitors;

electrically coupling each first capacitor to a data line of the LCD panel;

providing at least one set of transistors disposed outside the cell matrix;

electrically coupling each transistor of a set to one of the plurality of first capacitors;

providing at least one set of second capacitors disposed outside the cell matrix;

electrically coupling each set of second capacitors to a set of transistors;

providing at least one control signal;

electrically coupling each control signal to a set of transistors, each control signal functioning to switch between a first and a second state to control the operation state of an associated set of transistors;

switching the at least one control signal to a first state in a first sequence starting from a first control signal to a last control signal such that voltage levels of a second capacitor and an associated first capacitor are averaged in proportion to their respective capacitance values; and switching the at least one control signal in a second sequence starting from the last control signal to the first control signal such that voltage levels of a second capacitor and an associated first capacitor are averaged in proportion to their respective capacitance values.

16. The method of claim 15, further comprising repeating the first and second sequences.

17. The method of claim 15, further comprising coupling a gate of each transistor of a set to an associated control signal, coupling a first terminal of the each transistor of a set to an associated first capacitor, and coupling a second terminal of the each transistor of a set to an associated second capacitor.

18. The method of claim 15, further comprising coupling the second terminals of at least two transistors of a set to a same second capacitor.

19. The method of claim 15, wherein each first capacitor includes a first capacitance value, and each second capacitor includes a second capacitance value substantially the same as the first capacitance value.

20. The method of claim 15, wherein the at least one set of transistors includes amorphous or poly-crystalline thin film transistors.

* * * * *